United States Patent [19]

Wentzheimer

[11] 4,072,603

[45] Feb. 7, 1978

[54] PROCESS TO MAKE TECHNICAL WHITE OILS

[75] Inventor: William W. Wentzheimer, Glen Mills, Pa.

[73] Assignee: Suntech, Inc., Wayne, Pa.

[21] Appl. No.: 736,783

[22] Filed: Oct. 29, 1976

[51] Int. Cl.[2] ..... C10G 37/06

[52] U.S. Cl. ..... 208/264; 208/14; 208/58

[58] Field of Search ..... 208/18, 58, 264, 14

[56] References Cited

U.S. PATENT DOCUMENTS

| | | | |
|---|---|---|---|
| 3,392,112 | 7/1968 | Bercik et al. | 208/210 |
| 3,459,656 | 8/1969 | Rausch | 208/18 |
| 3,506,565 | 4/1970 | White et al. | 208/18 |
| 3,788,972 | 1/1974 | Henry et al. | 208/18 |
| 3,968,023 | 7/1976 | Yan | 208/18 |

*Primary Examiner*—Herbert Levine

*Attorney, Agent, or Firm*—J. Edward Hess; Donald R. Johnson; Paul Lipsitz

[57] ABSTRACT

A process for making technical white oils in a single step hydrogenation and without the need for acid treating to meet white oil specification by hydrogenating a hydrocracked solvent extracted lubricating oil distilling between 650° and 1050° F, having a SUS/100° F viscosity of about 200 and an aromatic content of less than about 15% in a single step at 600° to 700° F, and at 2000 to 3000 psig in the presence of a catalyst comprising nickel and tungsten supported on silica-alumina, subjecting the hydrogenated solvent extracted lube oil to atmospheric distillation to remove distillates useful as fuels and subjecting the bottoms of said atmospheric distillation to a vacuum distillation to yield various viscosity grades of technical white oils.

3 Claims, No Drawings

PROCESS TO MAKE TECHNICAL WHITE OILS

It is known in the art to make white oils from various feedstocks derived from either naphthenic or paraffinic crude oils. Two grades of white oils can be derived from these hydrocarbons; e.g. technical white oils and a more highly refined food or medicinal grade of white oil. In the preparation of technical white oils it is customary to charge a solvent extracted lubricating oil to an acid treating plant where the oil is treated with sulfuric acid. The acid reacts with and solubilizes unwanted aromatic compounds in the oil and thereby purifies it. Acid treating, however, is costly and produces large amounts of acid sludge and spent acid which are difficult to handle in an environmentally satisfactory manner.

Recently, there have been developed two-stage catalytic hydrogenation processes for making food grade white oil wherein the aromatics are converted by hydrogenation in two separate reactors to saturated hydrocarbons, thus obviating the need for acid treatment of the final food grade white oil. Each reactor employs different catalysts and different conditions. However, as pointed out in an article by J. B. Gilbert et al appearing at pages 87–89 of Chemical Engineering, Sept. 15, 1975, which discusses such a two stage process, the first hydrotreating stage can prepare white-oil charge stock for acid treating and technical grade white oils may be made in this manner.

The present invention enables technical white oils to be prepared in a single stage hydrogenation without the need for acid treating and produces a product fully meeting the specifications for such oils. In accord with the invention technical white oils having a SUS/100° F viscosity below about 400 are made by hydrogenating in a single step a hydrocracked solvent extracted lubricating oil distilling between 650° and 1050° F, having a SUS/100° F viscosity of about 200 and an aromatic content of less than about 15%, at 600° to 700° F and at 2000 to 3000 psig in the presence of a catalyst comprising nickel and tungsten supported on silica-alumina. When the hydrogenation is completed the product is subjected to atmospheric distillation to remove distillates useful as fuels and the bottoms of that distillation are subjected to a vacuum distillation to yield the technical white oils as the distillate products.

As indicated the feedstock to the hydrogenator of subject process will be a hydrocracked solvent extracted lubricating oil distilling between 650° and 1050° F having a SUS/100° F viscosity of about 200 and an aromatic content of less than about 15%. The charge stock may be either a wide boiling lubricating oil with TBP cut points of 650° to 1050° F or narrow boiling lubes with a TBP cut point range of 50° to 150° F. This charge stock is preferably made from a mixture of about 40% by volume of a furfural extracted dearomatized vacuum gas oil and about 60% by volume of a virgin vacuum gas oil which is refined by hydrocracking into a lube quality oil (high VI, 95–105; aromatic content 10 to 15% by volume), and the portion boiling above 650° F is a waxy lube oil which is solvent dewaxed (as with methyl ethyl ketone) and U.V. stabilized with a light furfural extraction. Alternatively, a 100% virgin vacuum gas oil may be refined by hydrocracking into a lube quality oil which is subsequently solvent dewaxed and stabilized.

The hydrogenation step of the process is carried out at 600° F to 700° F at a pressure of 2000 to 3000 psig and in the presence of a catalyst, as indicated. The catalyst will be a combination of nickel and tungsten supported on silica-alumina, the amount of nickel on the total catalyst and support being from about 2% to about 10% (preferably 5% to about 6%) by weight and the amount of tungsten being from about 10% to about 25% (preferably 13 to about 18%) by weight. Such catalysts are commercially available and are typified by GC-36 available from Gulf Oil.

The reaction condition may vary over a fairly wide range and typical reaction conditions are shown in the following Table I:

TABLE I

| Hydrogenation Reaction Conditions | Range | Preferred |
|---|---|---|
| Pressure, PSIG | 2000–3000 | 2400–2800 |
| LHSV (Liquid Hourly Space Viscosity) | 0.3–1.5 | 0.8–1.2 |
| Temperature, ° F | 600–700 | 630–650 |

After hydrogenation, the product is subjected to a distillation at atmospheric pressure, usually at about 675° F and about 30 psig, or slightly higher and the distillate products provide a source of fuels. The bottoms from this distillation are vacuum distilled usually at about 650° F and at about 70mm Hg. pressure and the distillate products are the desired technical white oils.

Following the above described process in accord with the invention a narrow boiling hydrocracked solvent lube oil charge stock is typically converted to technical white oil in accord with the specifications in Table II.

TABLE II

| | | Hydrocracked Solvent Extracted Lube (Charge Stock) | Product Technical White Oil |
|---|---|---|---|
| Viscosity, SUS/100° F | | 200 | 177 |
| Aromatics, wt.% | | 10.5 | 1.8 |
| Ultra violet Absorptivities | | | |
| 260 mμ | | 0.266 | 0.018 |
| 290 mμ | | 0.129 | 0.004 |
| 343 mμ | | 0.012 | 0.003 |
| FDA 121.2580 (b) | Spec | | |
| 280/289 mμ | 4.0 | 2.32 | 0.443 |
| 290/299 mμ | 3.3 | 1.70 | 0.202 |
| 300/329 mμ | 2.3 | 1.32 | 0.083 |
| 330/350 mμ | 0.8 | 0.902 | 0.069 |
| UV Stability | | | |
| 45 hr, % Transmission | | 50 | 75 |
| Heat Stability | | | |
| 6 hr at 300° F, % Transmission | | 3 | 96 |

Thus, it can be seen that the product white oil fully meets the specifications of FDA 121–2580(b).

In order to further illustrate the process of the invention the following examples are given in Table III.

TABLE III

WHITE OIL BY HYDROGENATION OF HPO 200[1]

| | HPO 200 Feed | Technical White Oil Product | | | | |
|---|---|---|---|---|---|---|
| Process Conditions | | Ex 1 | Ex 2 | Ex 3 | Ex 4 | Ex 5 |
| Temp. ° F | | 670 | 650 | 650 | 650 | 630 |
| LHSV, 1/hr | | 1.25 | 1.5 | 1.25 | 1.0 | 1.25 |
| Pressure ($H_2$), psig | | | | 2675 | | |
| Yield, Vol % | | 98 | 99+ | 99+ | 99+ | 99+ |
| Product Properties | | | | | | |
| Aromatics, wt % | 10.8 | 4.2 | 5.4 | 4.6 | 3.6 | 5.4 |
| Sulfur, ppm | 574 | 4 | 14 | 14 | 7 | 16 |
| KV/100° F | 43.8 | 31.7 | 37.3 | 39.5 | 36.3 | 39.5 |
| KV/210° F | 6.5 | 5.4 | 5.9 | 6.1 | 5.8 | 6.1 |

TABLE III-continued

WHITE OIL BY HYDROGENATION OF HPO 200[1]

| | HPO 200 Feed | Technical White Oil Product | | | | |
|---|---|---|---|---|---|---|
| VI | 108 | 117 | 113 | 111 | 113 | 111 |
| °API | 32.9 | 34.9 | 33.2 | 32.8 | 33.7 | 33.3 |
| Distillation, ° F | | | | | | |
| Initial B.P. | 672 | 404 | 641 | 668 | 641 | 660 |
| 5 | 732 | 718 | 726 | 737 | 726 | 754 |
| 10 | 757 | 749 | 754 | 764 | 754 | 754 |
| 20 | 790 | 784 | 787 | 798 | 788 | 787 |
| 30 | 813 | 808 | 812 | 823 | 811 | 812 |
| 40 | 833 | 829 | 832 | 844 | 832 | 832 |
| 50 | 852 | 848 | 851 | 862 | 850 | 850 |
| 60 | 870 | 867 | 869 | 880 | 868 | 868 |
| 70 | 889 | 886 | 888 | 899 | 887 | 887 |
| 80 | 910 | 908 | 910 | 920 | 908 | 908 |
| 90 | 937 | 936 | 937 | 947 | 936 | 936 |
| 95 | 959 | 957 | 961 | 966 | 957 | 957 |
| End Point | 1014 | 1013 | 1020 | 1015 | 1010 | 1012 |
| UV Stability, 45 hr oven test | | | | | | |
| Color, D-1500 Initial | 0.5 | <0.5 | <0.5 | <0.5 | <0.5 | <0.5 |
| Color, D-1500 Aged | 5.0 | 1.1 | 1.0 | 1.0 | 1.0 | 1.0 |

[1] A hydrocracked petroleum oil having an SUS/100° F viscosity of 200.

The invention claimed is:

1. A process for making technical white oils in a single hydrogenation and without the need for acid treating to meet white oil specifications which comprises hydrogenating a hydrocracked solvent extracted lubricating oil distilling at 650° to 1050° F, having a SUS/100° F viscosity of about 200 and an aromatic content of less than about 15% in a single step at 600° to 700° F, and at 2000 to 3000 psig in the presence of a catalyst comprising nickel and tungsten supported on silica-alumina, subjecting the hydrogenated solvent lube oil to atmospheric distillation to remove distillates useful as fuels and subjecting the bottoms of said atmospheric distillation to a vacuum distillation to yield technical white oils as products.

2. The process of claim 1 where the charge stock is a mixture of about 40% by volume of a furfural extracted dearomatized vacuum gas oil and about 60% of a virgin vacuum gas oil which is refined by hydrocracking into a lube quality oil having a high VI of about 95 to 105 and an aromatic content of about 10% to about 15% by volume, and the portion boiling above 650° F is solvent dewaxed and U.V. stabilized with a light furfural extraction.

3. The process of claim 1 where the charge stock is a 100% virgin vacuum gas oil which is refined by hydrocracking into a lube quality oil having a high VI of about 95 to 105 and an aromatic content of about 10% to about 15% by volume, and the portion boiling above 650° F is solvent dewaxed and U.V. stabilized with a light furfural extraction.

* * * * *